US011543212B1

(12) United States Patent
Letts

(10) Patent No.: US 11,543,212 B1
(45) Date of Patent: Jan. 3, 2023

(54) INDEXING SCOPE MOUNT ASSEMBLY

(71) Applicant: Phillip Letts, Corpus Christi, TX (US)

(72) Inventor: Phillip Letts, Corpus Christi, TX (US)

( * ) Notice: Subject to any disclaimer, the term of this patent is extended or adjusted under 35 U.S.C. 154(b) by 0 days.

(21) Appl. No.: 17/066,552

(22) Filed: Oct. 9, 2020

Related U.S. Application Data

(60) Provisional application No. 62/939,056, filed on Nov. 22, 2019.

(51) Int. Cl.
*F41G 11/00* (2006.01)

(52) U.S. Cl.
CPC ..... *F41G 11/003* (2013.01)

(58) Field of Classification Search
CPC ..... F41G 11/003; F41G 1/387; F41G 1/16
See application file for complete search history.

(56) References Cited

U.S. PATENT DOCUMENTS 960,813 A * 6/1910 Burton ..... F41G 11/003 42/124
1,641,019 A * 8/1927 Woods ..... F41G 11/002 42/124
1,899,249 A * 2/1933 Walliser ..... F41G 11/004 248/231.31
2,151,768 A * 3/1939 Humeston ..... F41G 11/003 42/124
2,187,054 A * 1/1940 Redfield ..... F41G 11/003 42/125
2,236,736 A * 4/1941 Scott ..... F41G 1/35 362/110
2,539,008 A 1/1951 Brookhyser
2,576,007 A * 11/1951 Fischer ..... F41G 11/001 42/126
2,580,246 A 12/1951 Schall
2,663,083 A 12/1953 Harms
2,717,447 A * 9/1955 Leupold ..... F41G 11/001 42/127
2,857,675 A * 10/1958 Kesselring ..... F41G 11/001 42/127
3,133,353 A * 5/1964 Williams ..... F41G 1/42 42/141
3,187,435 A * 6/1965 Miller, Jr. ..... F41G 11/006 42/126
3,559,940 A * 2/1971 Kruzell ..... F41G 11/001 42/127
3,579,840 A * 5/1971 Heinzel ..... F41G 11/003 42/127
3,734,437 A * 5/1973 Underwood ..... F41G 11/003 248/205.1
3,785,603 A * 1/1974 Apel ..... F41G 11/001 248/222.13

(Continued)

FOREIGN PATENT DOCUMENTS

EP 2570762 3/2013

*Primary Examiner* — Michelle Clement
(74) *Attorney, Agent, or Firm* — John Rizvi; John Rizvi, P.A.—The Patent Professor®

(57) ABSTRACT

A riflescope mount assembly that corrects cant is provided. The riflescope mount comprises at least one indexing bar attachable to a riflescope, and a mounting bracket that is mountable or attachable to the riflescope. The mounting bracket may include at least one auto indexing mechanism and at least one mechanical indexing mechanism that engages the at least one indexing bar attached to the riflescope.

21 Claims, 9 Drawing Sheets

(56) References Cited

U.S. PATENT DOCUMENTS 3,877,166 A * 4/1975 Ward ..... F41G 11/003 42/127
4,021,954 A * 5/1977 Crawford ..... F41G 11/003 42/127
4,085,511 A 4/1978 Kovac
4,092,793 A 6/1978 Ricks
4,121,363 A 10/1978 York
4,216,600 A * 8/1980 Brueckner ..... F41G 11/001 42/127
4,249,315 A * 2/1981 Hopson, III ..... F41G 11/003 42/125
4,291,476 A * 9/1981 Repa ..... F41G 11/007 42/124
4,353,180 A * 10/1982 Wilson ..... F41G 11/006 42/127
4,562,658 A * 1/1986 Govett ..... F41G 11/001 42/125
4,742,636 A * 5/1988 Swan ..... F41G 11/006 42/126
4,756,111 A * 7/1988 Lapier ..... F41G 11/004 42/128
4,860,480 A * 8/1989 Ruger ..... F41G 11/001 42/124
4,959,908 A * 10/1990 Weyrauch ..... F16B 3/00 42/124
5,035,487 A * 7/1991 Herz ..... F41G 11/001 359/896
5,070,637 A * 12/1991 French ..... F41G 11/007 42/122
5,111,587 A 5/1992 Plank
5,144,752 A * 9/1992 Boeke ..... F41G 11/001 42/125
5,155,915 A * 10/1992 Repa ..... F41G 1/383 42/127
5,428,915 A 7/1995 King
5,490,654 A * 2/1996 Herriman ..... F41G 11/001 248/309.1
5,533,267 A * 7/1996 Haight, Jr. ..... F41G 11/002 42/124
5,584,137 A * 12/1996 Teetzel ..... F41A 9/62 362/114
5,590,484 A 1/1997 Mooney et al.
5,606,818 A 3/1997 Hardee
5,680,725 A * 10/1997 Bell ..... F41G 11/003 42/127
5,787,630 A 8/1998 Martel
6,026,580 A * 2/2000 LaRue ..... F41G 11/001 42/124
6,435,738 B1 * 8/2002 Vogt ..... F16M 11/041 396/419
6,598,331 B1 * 7/2003 Thibodeaux ..... F41G 1/41 42/111
6,609,325 B2 8/2003 Harris
6,637,144 B2 * 10/2003 Nelson ..... F41G 1/35 42/120
6,705,038 B2 * 3/2004 Davenport ..... F41G 11/004 42/127
6,901,692 B2 * 6/2005 Miller ..... F41G 11/003 33/263
6,922,934 B1 * 8/2005 Huan ..... F41G 11/003 42/127
7,062,876 B2 6/2006 Wilson
7,121,037 B2 * 10/2006 Penney ..... F41G 11/001 42/126
7,204,052 B2 4/2007 Swan
D594,318 S * 6/2009 Fell ..... D22/110
7,823,316 B2 * 11/2010 Storch ..... F41G 11/003 42/90
7,870,688 B1 1/2011 Dasiukevich
7,971,384 B2 7/2011 Lippard
8,006,430 B2 * 8/2011 Wang ..... F41G 11/003 42/125
8,011,130 B2 * 9/2011 Chang ..... F41G 11/002 42/124
8,132,355 B1 * 3/2012 Kincaid ..... F41C 33/041 42/124
8,151,508 B1 4/2012 Moore
8,171,666 B2 * 5/2012 Karagias ..... F41G 11/003 42/124
8,240,075 B1 8/2012 Mullin
8,336,247 B2 * 12/2012 Haering ..... F41G 11/003 42/127
8,353,125 B2 * 1/2013 Riley ..... F41G 11/003 42/90
8,393,105 B1 * 3/2013 Thummel ..... F41G 11/003 42/90
8,438,965 B2 * 5/2013 Collin ..... F41G 11/003 89/125
8,533,989 B2 * 9/2013 Ziegler ..... F41G 11/007 42/124
8,561,341 B1 10/2013 Dihlmann
8,567,105 B1 * 10/2013 Bobro ..... F41G 11/003 42/90
8,769,859 B2 * 7/2014 Li ..... F41G 11/003 42/124
8,925,238 B2 * 1/2015 Anderson ..... F41G 1/12 42/132
8,935,875 B2 * 1/2015 Collin ..... F41G 11/003 42/90
9,015,982 B1 4/2015 Powers
9,222,756 B1 * 12/2015 Battaglia ..... F41G 11/003
9,297,616 B2 * 3/2016 Daniel ..... F41G 11/004
9,303,952 B2 * 4/2016 Hakansson ..... F41G 1/38
9,383,167 B1 * 7/2016 Connolly ..... F41G 1/387
9,658,031 B1 * 5/2017 Hedeen ..... F41G 1/35
10,024,632 B1 * 7/2018 Oglesby ..... F41C 27/00
10,048,040 B1 * 8/2018 Ratliff ..... F41G 11/003
10,060,704 B2 8/2018 Brice
10,107,592 B1 * 10/2018 Huang ..... F41G 1/35
10,234,237 B1 * 3/2019 Jager ..... F41G 1/01
10,240,901 B1 * 3/2019 Cheng ..... F41A 35/00
10,267,599 B1 * 4/2019 Britt ..... F41C 27/22
10,309,752 B1 * 6/2019 Britt ..... F41G 11/002
10,371,317 B2 * 8/2019 Chen ..... F16M 13/022
10,415,934 B2 * 9/2019 Babbitt ..... F16B 2/065
10,801,814 B2 * 10/2020 Ma ..... F41G 1/35
10,895,436 B2 * 1/2021 Ross ..... F41G 11/003
10,928,051 B1 * 2/2021 Worman ..... F21L 4/00
10,969,201 B1 * 4/2021 Pischke ..... F41G 1/34
11,085,736 B2 * 8/2021 Johnson, Sr. ..... F41G 11/003
11,092,437 B1 * 8/2021 McCoy, II ..... F41G 1/54
11,118,859 B1 * 9/2021 Hawk ..... F21V 23/0414
2002/0104249 A1 * 8/2002 Lin ..... F41G 11/004 42/114
2003/0056417 A1 * 3/2003 Horton ..... F41G 11/007 42/124
2004/0009034 A1 * 1/2004 Miller ..... F41G 11/003 403/363
2004/0190135 A1 * 9/2004 Recknagel ..... F41G 11/003 359/399
2007/0234623 A1 * 10/2007 Carney ..... F41G 11/003 42/95
2008/0034638 A1 * 2/2008 Spuhr ..... F41G 11/006 42/127
2008/0168696 A1 * 7/2008 Orne ..... F41A 35/00 42/90
2008/0178511 A1 * 7/2008 Storch ..... F41C 27/00 42/90
2010/0229448 A1 * 9/2010 Houde-Walter ..... F41C 23/16 42/72
2011/0047851 A1 * 3/2011 Mock ..... F41G 1/35 42/72
2011/0058362 A1 * 3/2011 Sun ..... F41G 1/35 362/187
2011/0061283 A1 * 3/2011 Cavallo ..... F41G 11/003 42/72
2011/0061286 A1 * 3/2011 Wang ..... F41G 11/003 42/125

(56) References Cited

U.S. PATENT DOCUMENTS

2011/0076095 A1* 3/2011 Storch ..... F41G 11/003 403/322.4
2011/0146128 A1* 6/2011 Haering ..... F41G 11/003 42/90
2011/0146131 A1* 6/2011 Ziegler ..... F41G 11/007 42/125
2011/0247258 A1* 10/2011 Gentilini ..... F41G 1/16 42/135
2011/0283590 A1* 11/2011 Chiang ..... F41G 11/003 42/124
2012/0167438 A1* 7/2012 Daniel ..... F41G 11/004 42/90
2012/0227304 A1* 9/2012 Engelhardt ..... F41C 27/00 42/90
2013/0104441 A1* 5/2013 Kincel ..... F41G 11/004 42/90
2013/0145666 A1* 6/2013 Eriksson ..... F41G 1/30 42/1.06
2014/0123537 A1* 5/2014 Anderson ..... F41G 1/16 42/132
2014/0196348 A1* 7/2014 Samson ..... F41C 27/00 42/90
2014/0252187 A1* 9/2014 Petrovic ..... F16B 2/185 248/229.16
2014/0305021 A1* 10/2014 Prieto ..... F41G 11/003 42/111
2015/0000172 A1* 1/2015 Oglesby ..... F41G 11/001 42/90
2015/0135574 A1* 5/2015 Jen ..... F41C 23/02 42/90
2017/0030682 A1 2/2017 Pearson
2017/0038177 A1* 2/2017 Sun ..... F41G 1/345
2017/0045334 A1* 2/2017 Yim ..... F16M 13/02
2018/0058813 A1* 3/2018 Minor ..... F41G 1/387
2018/0142991 A1* 5/2018 Rogers ..... F41G 11/004
2018/0202769 A1* 7/2018 Kolvek ..... F41C 27/00
2018/0283670 A1* 10/2018 Galli ..... F41G 1/36
2018/0340754 A1* 11/2018 Cosentino ..... F41G 11/003
2018/0340755 A1* 11/2018 Cosentino ..... F41G 11/003
2018/0347950 A1* 12/2018 Swan ..... F41G 11/003
2018/0364009 A1* 12/2018 Hancosky ..... F41G 1/35
2019/0003799 A1* 1/2019 Brown ..... F41B 5/1442
2019/0011225 A1* 1/2019 Sun ..... F41G 1/545
2019/0078853 A1* 3/2019 Johnson, Sr. ..... F41A 25/14
2019/0128636 A1* 5/2019 Brown ..... F41B 5/148
2019/0226799 A1* 7/2019 Hubbell ..... F41C 27/00
2019/0234710 A1* 8/2019 Batenhorst ..... F41G 11/004
2019/0242677 A1* 8/2019 Ding ..... F41G 11/003
2019/0249696 A1* 8/2019 Larue ..... F41G 11/003
2019/0277601 A1* 9/2019 Hanley ..... F41G 11/001
2019/0285386 A1* 9/2019 Burt ..... F41G 11/004
2019/0301835 A1* 10/2019 Tayon ..... F41G 1/35
2020/0003524 A1* 1/2020 Britt ..... F41G 11/003
2020/0025522 A1* 1/2020 Zimmer ..... F41G 11/003
2020/0049454 A1* 2/2020 Leutzinger ..... F41G 1/35
2020/0158468 A1* 5/2020 Garbouchian ..... F41G 1/42
2020/0240750 A1* 7/2020 Reed ..... F21V 23/04
2020/0256645 A1* 8/2020 Galli ..... F41G 1/35
2021/0108892 A1* 4/2021 Ma ..... F41C 27/00
2021/0389101 A1* 12/2021 Hughes ..... F41G 11/003

* cited by examiner

INDEXING SCOPE MOUNT ASSEMBLY

CROSS-REFERENCE TO RELATED APPLICATIONS

This application claims the benefit of U.S. Provisional Patent Application Ser. No. 62/939,056, filed on Nov. 22, 2019, which is incorporated herein in its entirety.

FIELD OF THE INVENTION

The present invention generally relates to riflescope mounts, and more particularly, to a riflescope mount assembly that eliminates or otherwise corrects cant introduced by a user when mounting a riflescope to a rifle.

BACKGROUND OF THE INVENTION

A telescopic sight, commonly referred to as a riflescope, is an optical sighting device that uses a lens to form an image. Riflescopes are generally equipped with some form of graphic image pattern, or reticle mounted in an optically appropriate position in its optical system to give an accurate aiming point.

In sport related activities such as long range shooting, a riflescope allows a shooter to identify his or her mark at a long distance that otherwise would not be discernible. This is especially true for shooters with poor eyesight who must rely on the scope to provide them with clarity. Although riflescopes are helpful, scope cant can cause many problems when it comes to long range shooting. Cant is defined as a set angle or pitch to one side. It is most commonly used to describe where the shooter is positioned on a slope and the rifle is not held vertically true.

There are several forms of cant shooters must deal with, such as rifle cant, scope cant, and reticle cant. Scope or riflescope cant occurs when the riflescope is not mounted level with the rifle. This is common, because mounting a riflescope level to a rifle requires specialized tools many shooters do not have at home. It is also true that most shooters that have specialized tools do not have the expertise to properly use them, and inevitably introduce cant. Moreover, mounting a riflescope to a rifle can be time consuming with the end product still being imperfect.

In addition to riflescope cant, reticle cant is a problem most shooters may not be aware of. Humans install reticles. Meaning, there is a high probability of error every time a reticle is mounted to a riflescope. Therefore, most manufacturers hold a tolerance standard within a plus or minus 5-degree cant. Only highly specialized manufactures are able to guarantee scopes that have tolerances of maximum 1-degree, or 0.5 degree off true center.

In order to understand the issues associated with cant, one must understand how cant affects the trajectory of a bullet. For example, a riflescope mounted with a 3-degree cant has a downrange effect of 3-inches off center at 400 yards. At 800 yards, the effect is 13-inches, and at 1,000 yards the effect is 24-inches.

When shooting a rifle, if the riflescope is level, reticle cant is not a big factor unless the reticle needs to be adjusted for long-range elevation corrections and or windage corrections. When making corrections the shooter adjusts the reticle using the scope's turrets to move the center of the reticle in a true up or down, and right or left direction. However, if the shooter makes corrections for windage and the reticle is not plumb, the shooter introduces lateral error into the shot at about the same level that would occur if the shooter's riflescope were not level.

This has led to solutions that are very complicated and difficult to execute in order to correct the aforementioned problems. Some solutions include external tools, and leveling tools that are difficult to handle and properly use. Other solutions include methods that require off the shelf products that have been proven to be unreliable.

Accordingly, there is an established need for a riflescope mount that overcomes the limitations of other riflescope mounts and other types of tools used to correct rifle cant that are overly complicated and difficult to use to solve the associated problems that remain unsolved.

SUMMARY OF THE INVENTION

Introducing a first embodiment of the invention, the present invention provides a riflescope mount assembly that corrects cant, the riflescope mount assembly comprising:

at least one indexing bar attachable to the riflescope; and a mounting bracket mountable to the riflescope, the mounting bracket including at least one auto indexing mechanism, wherein the auto indexing mechanism of the mounting bracket engages the at least one indexing bar when mounted to the riflescope.

In another aspect, the at least one indexing bar may comprise an elongated body having a flat top, a rounded bottom, opposite sides, and opposite ends.

In another aspect, the at least one indexing bar may include at least two apertures that are disposed about the opposite sides of the elongated body.

In another aspect, the riflescope mount assembly may include a plurality of mounting tabs that are attachable to the bottom of the riflescope.

In another aspect, the plurality of mounting tabs may be attached to the riflescope in pairs, wherein each pair may be adjacent one another and in a spaced-apart relationship disposed along a line such that a passageway is formed.

In another aspect, the at least one index bar may be slidable within the passageway formed by the pair of mounting tabs and secured to the mounting tabs.

In another aspect, the riflescope mount assembly may comprise at least two indexing bars.

In another aspect, the mounting bracket comprises a top head, a bottom head, a neck supporting the bottom head, and a pair of shoulders extending downwardly from the neck.

In another aspect, the top head of the mounting bracket may include a pair of opposite wings that extend outwardly from a concave shaped head.

In another aspect, the bottom head of the mounting bracket may include a pair of opposite wings that extend outwardly from a convex shaped head.

In another aspect, the top head of the mounting bracket may be selectively attachable to the bottom head of the mounting bracket.

In another aspect, the pad may be adhered to the interior surface of the top head and the bottom head of the mounting bracket to provide padding between the top and bottom head of the mounting bracket and the riflescope when the mounting bracket is mounted to the riflescope.

In another aspect, the at least one auto indexing mechanism may be disposed about the neck of the mounting bracket.

In another aspect, the auto indexing mechanism may include a pair of resilient members that engage the at least one indexing bar.

In another aspect, the mounting bracket may also comprise a mechanical indexing mechanism.

In another aspect, the mechanical indexing mechanism may include a pair of setscrews that engage the indexing bar.

In another aspect, the shoulders extending from the neck of the mounting bracket may be configured to engage a mounting rack on a rifle.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a riflescope mount assembly that corrects scope and reticle cant that is usually introduced by a user when mounting a riflescope to a rifle with conventional mounts. Generally, a user has to utilize external tools or methods to correct the cant unavoidably introduced. The present invention, however, eliminates the need of external tools and methods because the invention includes an auto indexing mechanism that corrects cant unavoidably introduced when mounting the riflescope to a rifle.

Figure 1:
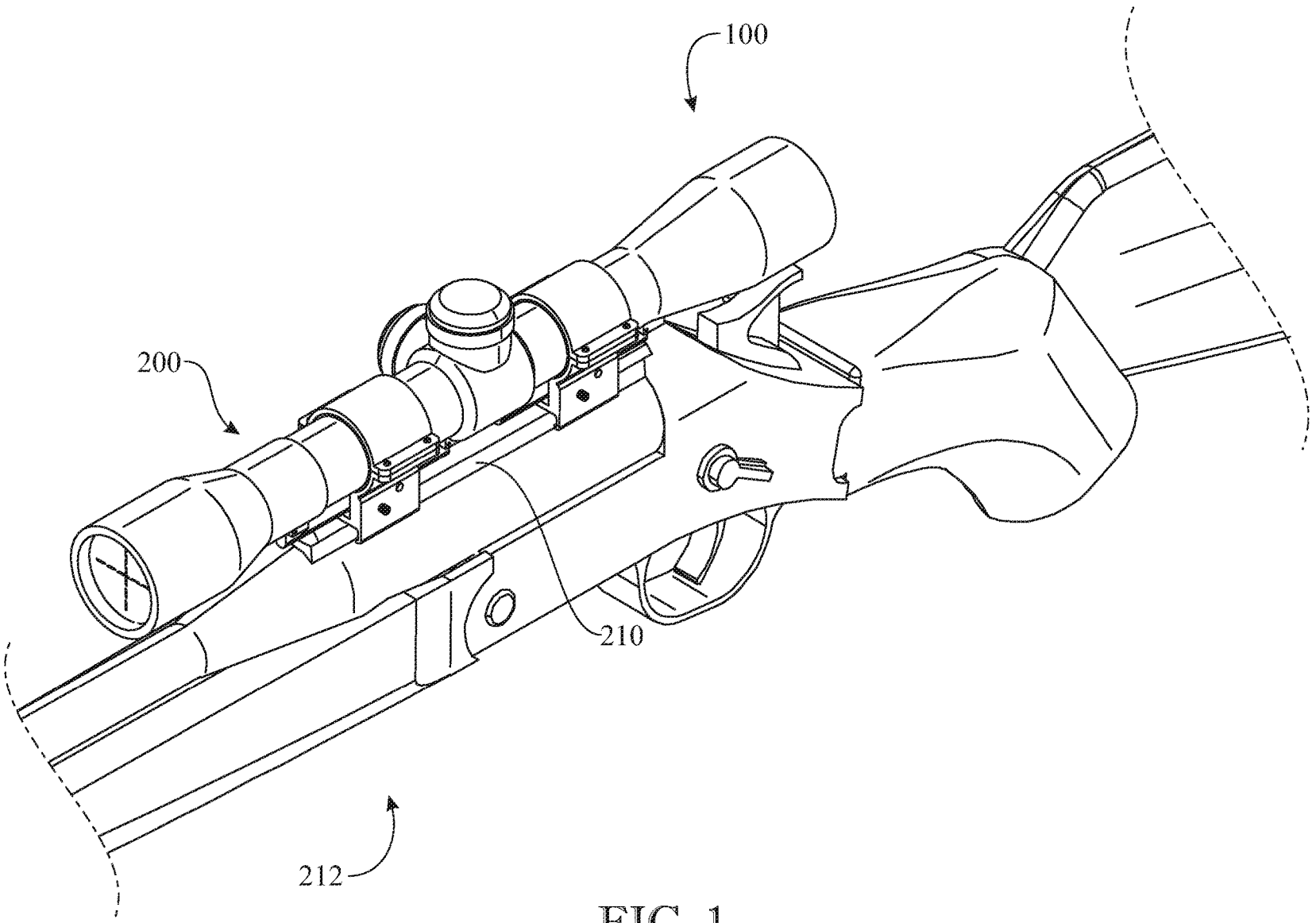
FIG. 1 presents a perspective view of a riflescope mounted to a rifle with a first embodiment of the riflescope mount assembly of the present invention.

Referring initially to FIGS. 1 through 6, and FIGS. 4-6 in particular, a riflescope mount assembly 100 is generally shown in accordance with a first embodiment of the present invention. The riflescope mount assembly 100 generally comprises at least one indexing bar 102 (FIG. 4) and a mounting bracket 116 (FIG. 5) that are attachable or mountable in combination to a riflescope 200. As discussed further, the combination of the indexing bar 102 and the mounting bracket 116 are designed and otherwise configured to correct or eliminate cant introduced when a user (not shown) mounts the riflescope 200 using the riflescope mount assembly 100 (hereinafter "mount assembly") to a mounting rack 210 on a rifle 212 (FIG. 1).

Figure 4:
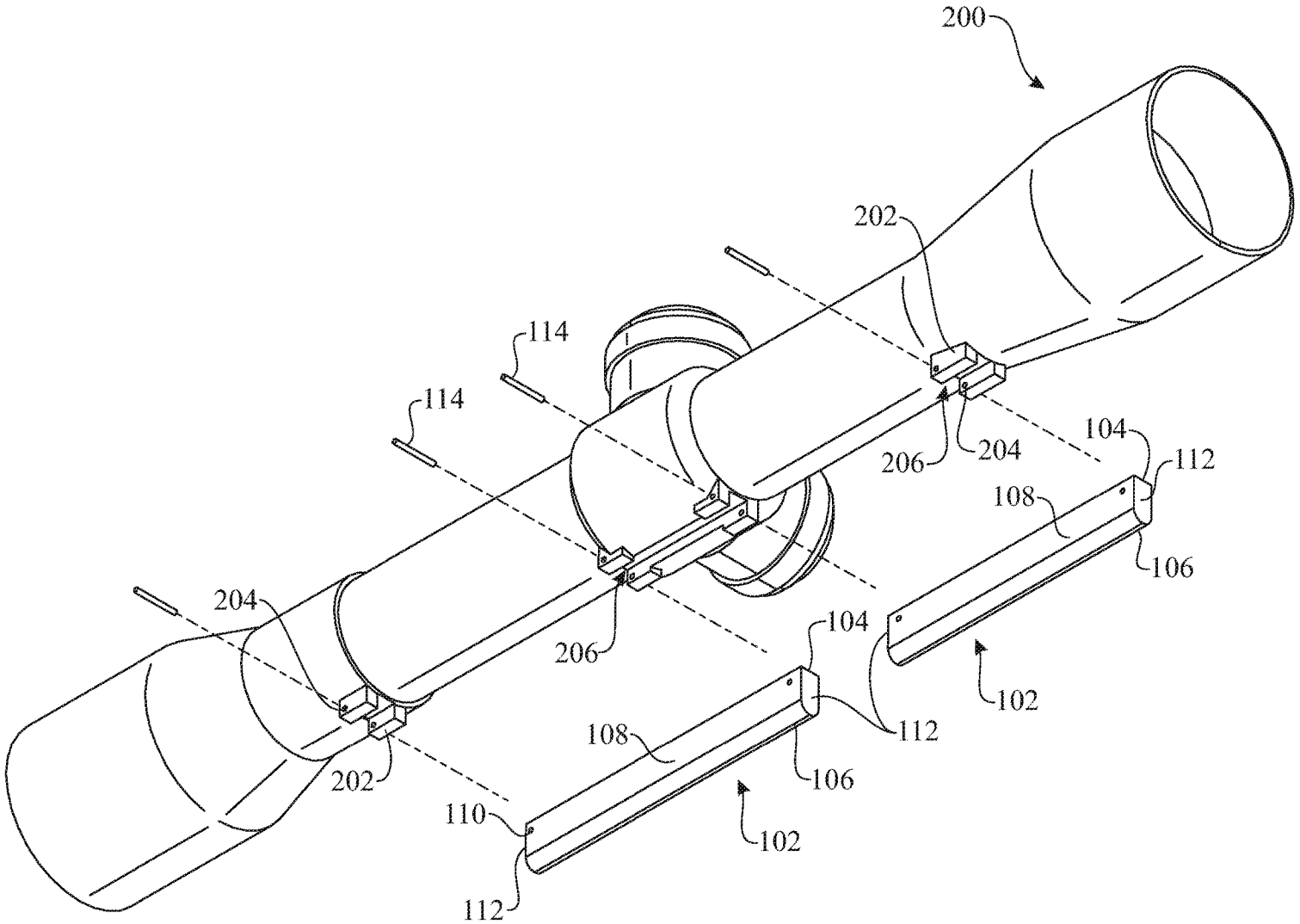
FIG. 4 presents a bottom perceptive, partial exploded view of the riflescope mount assembly originally presented in FIG. 1.

Referring to FIG. 4, the indexing bar 102 of the mount assembly 100 is attachable or mountable to a riflescope with the use of mounting tabs 204. Generally, riflescopes do not include mounting tabs 202. Therefore, the mounting assembly 100 of the present invention may be implemented in two versions, one where the mounting tabs 202 are added to the riflescope 200 in a retrofit configuration, and two, where the mounting tabs 202 are a built-in component incorporated to the riflescope 200 during the manufacturing process. In the case of the former version, the mounting tabs 202 may be attached, bonded, adhered, or fused to the riflescope in any conventional manner that does not damage or alter the casing of the riflescope. As shown, the mounting tabs 202 are attachable to the riflescope 200 in pairs. Each pair of mounting tabs 202 are adjacent one another and in a spaced-apart relationship, thus providing a passageway 206. Each mounting tab may include an aperture 204 configurable to receive a fastener 114. The plurality of pairs of mounting tabs 202 are arrangeable in a sequential line order to faun a passageway 206 that is configured to receive the indexing bar 102 of the mounting assembly 100. When the mounting tabs 202 are built-in to the riflescope 200 during the manufacturing process, it should be readily apparent that the arrangement of the mounting tabs 202 remain the same as described herein above.

With continued reference to FIG. 4, the index bar 102 of the mounting assembly 100 generally comprises an elongated body having a flat top 104, a rounded bottom 106, opposite sides 108 that are flat, and opposite ends 112 that are also flat. The index bar 102 may also include at least two apertures 110 that are disposed about the opposite sides 108 of the elongated body and near the opposite ends 110 thereof. As is best understood by the drawings, the width of the index bar 102 is smaller than the width of the passageway 206 formed between each pair of mounting tabs 202 attached or formed on the riflescope 200.

Figure 2:
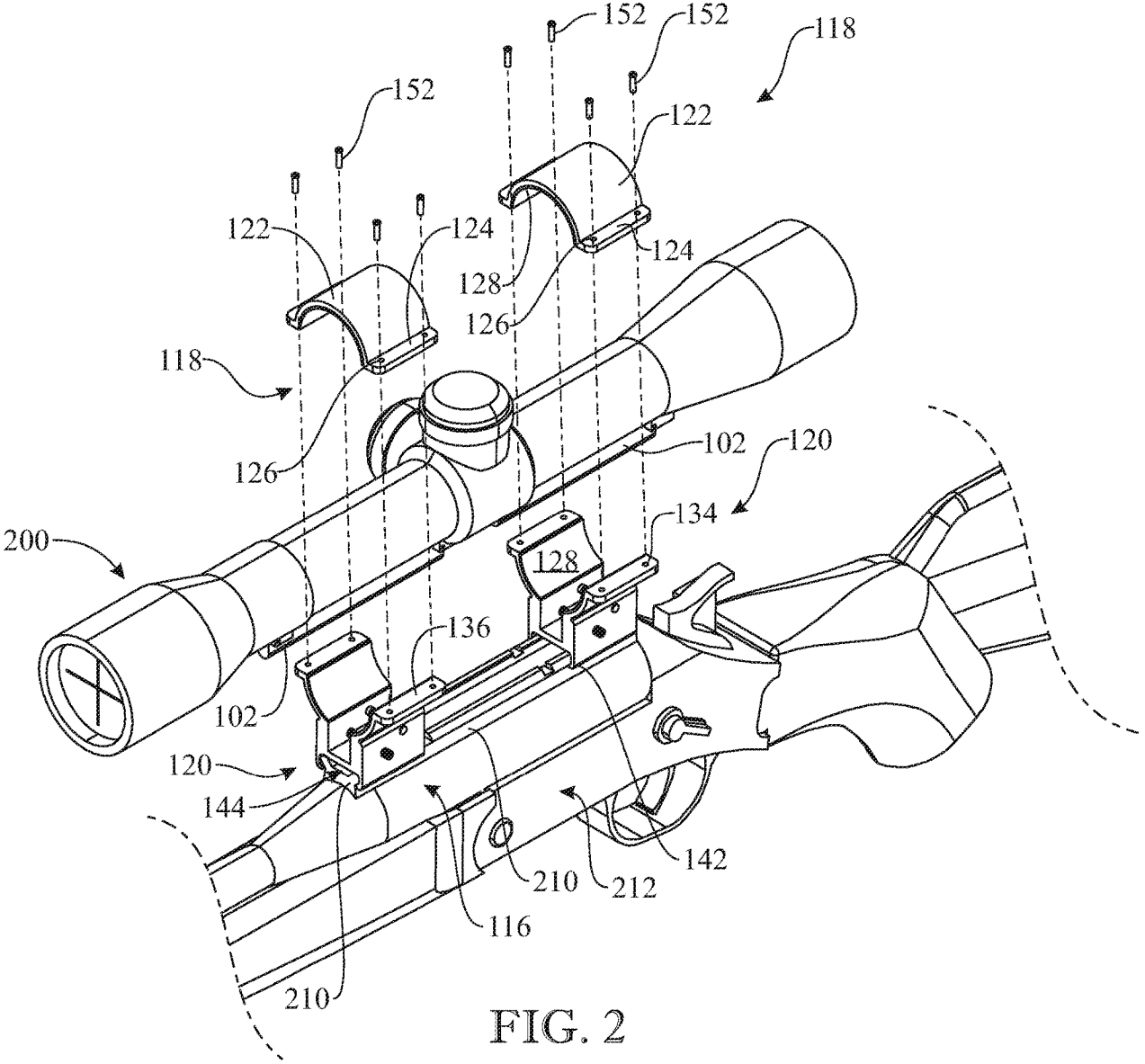
FIG. 2 presents an exploded view of the first embodiment of the riflescope mount assembly of the present invention.
Figure 3:
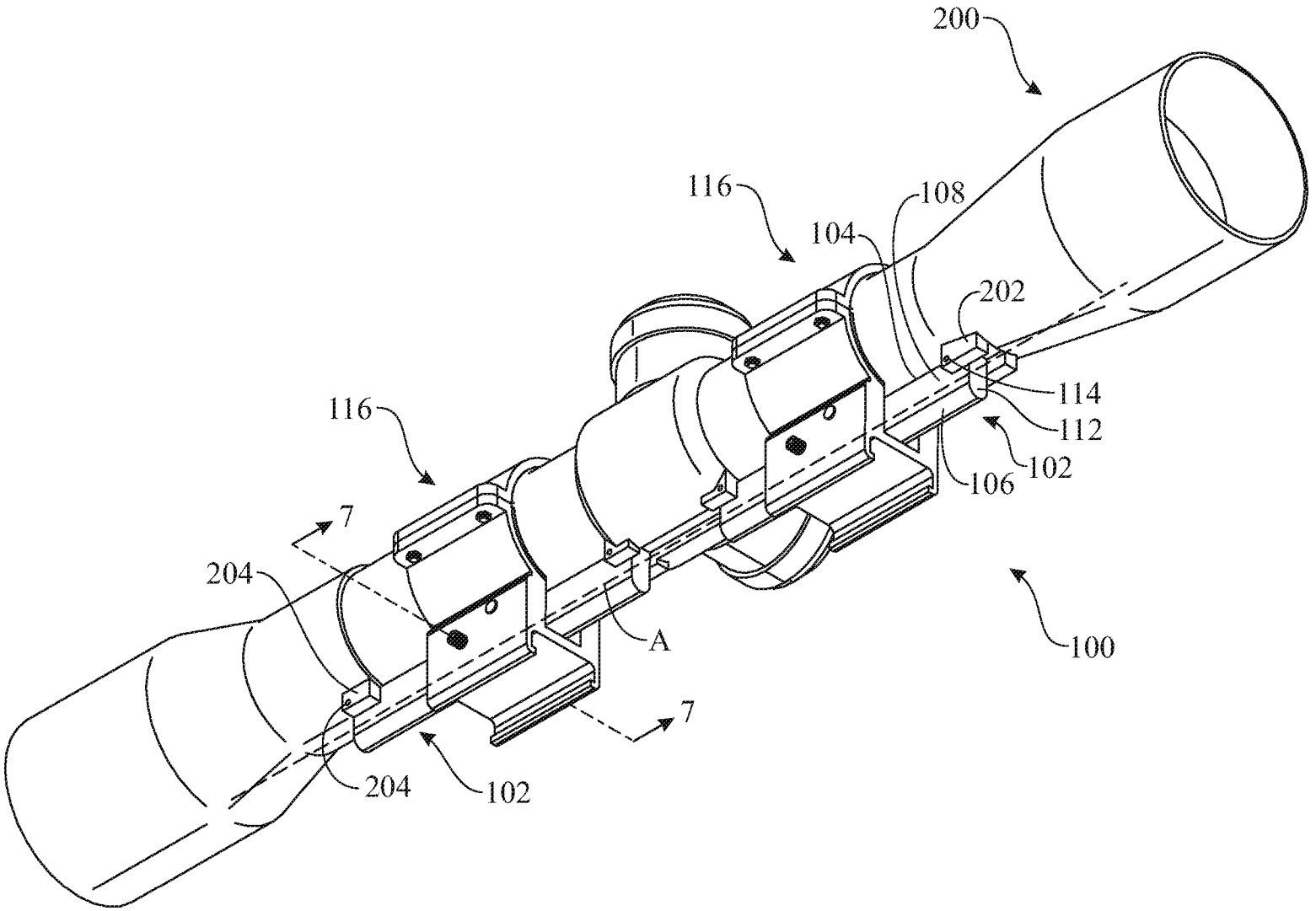
FIG. 3 presents a bottom perspective view of the riflescope mount assembly mounted to a rifle scope.
Figure 7:
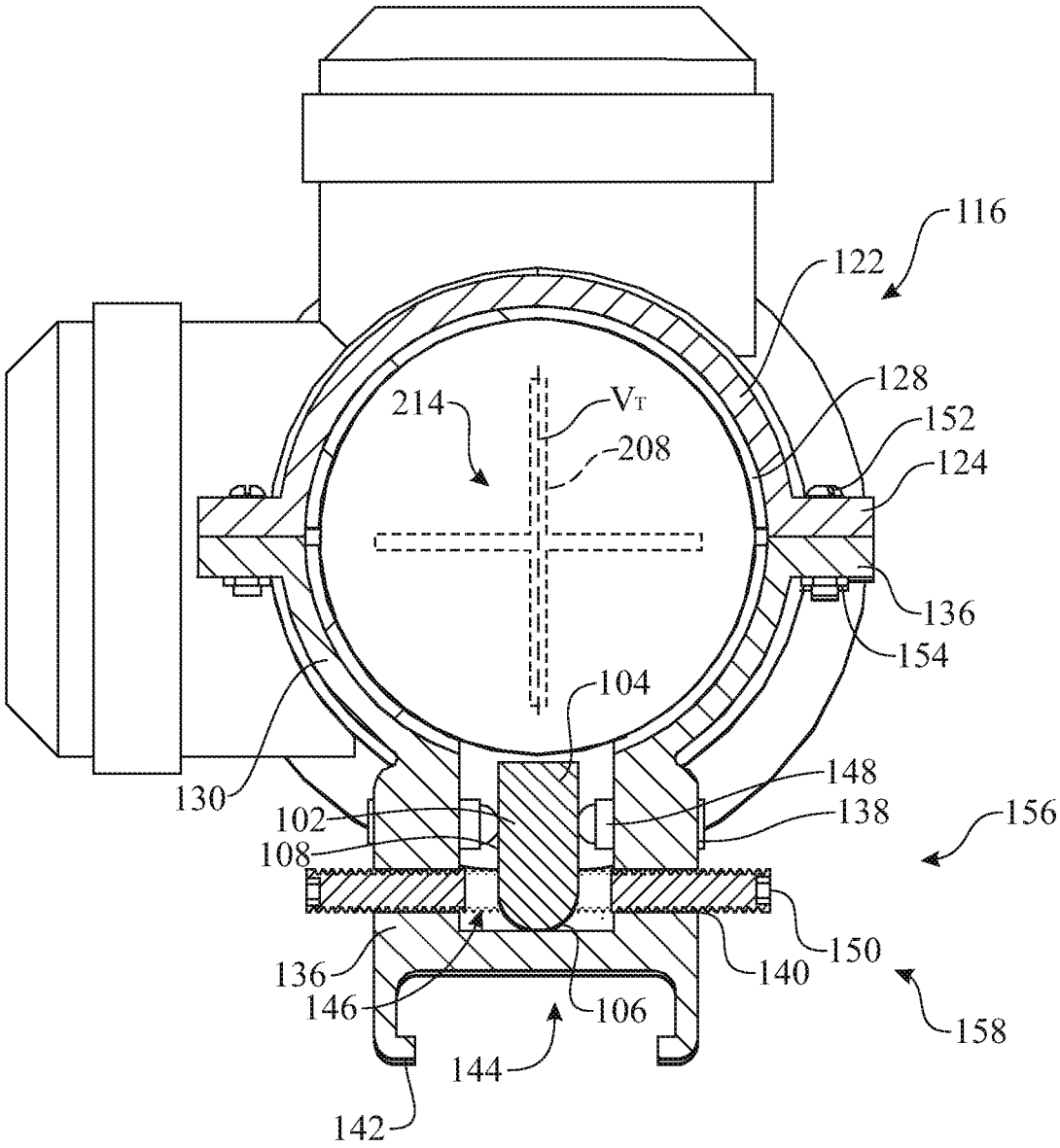
FIG. 7 presents a cross-sectional view of the mounting bracket presented in FIG. 5 attached to a riflescope mount.

Referring now to FIGS. 3 and 4, the indexing bar 102 of the mounting assembly 100 is securably attachable to the riflescope 200 by using the mounting tabs 202 on the riflescope 200. This is done by inserting or sliding the index bar between passageway(s) 206 until the apertures 110 of the index bar 102 are concentric with the apertures 204 on at least two pairs of mounting tabs 202. As shown in FIG. 3, the flat top 104 of the index bar 102 makes contact with the exterior casing of the riflescope 200, with the rounded bottom 106 of the bar facing in the opposite direction, or away from the exterior casing. The index bar extends along the centerline A of the riflescope that aligns perfectly with the vertical crosshair 208 on the reticle (FIG. 7). The index bar 102 is securable between the pair of mounting tabs 202 with a fastener 114 that is press-fitted through the concentric apertures of the mounting tabs 202 and index bar 102. The attachment of the index bar 102 to the riflescope 200 using the mounting tabs 204 form an integral one-piece construction (FIG. 2). Thus as assembled, any input directed to the index bar 102 will affect the rest of the riflescope 200. The index bar 102 and mounting tabs 202 of the mount assembly 100 are made out of composite material, metal, durable plastic, or the like that is attachable, fuseable, or bondable to the riflescope 200.

Figure 5:
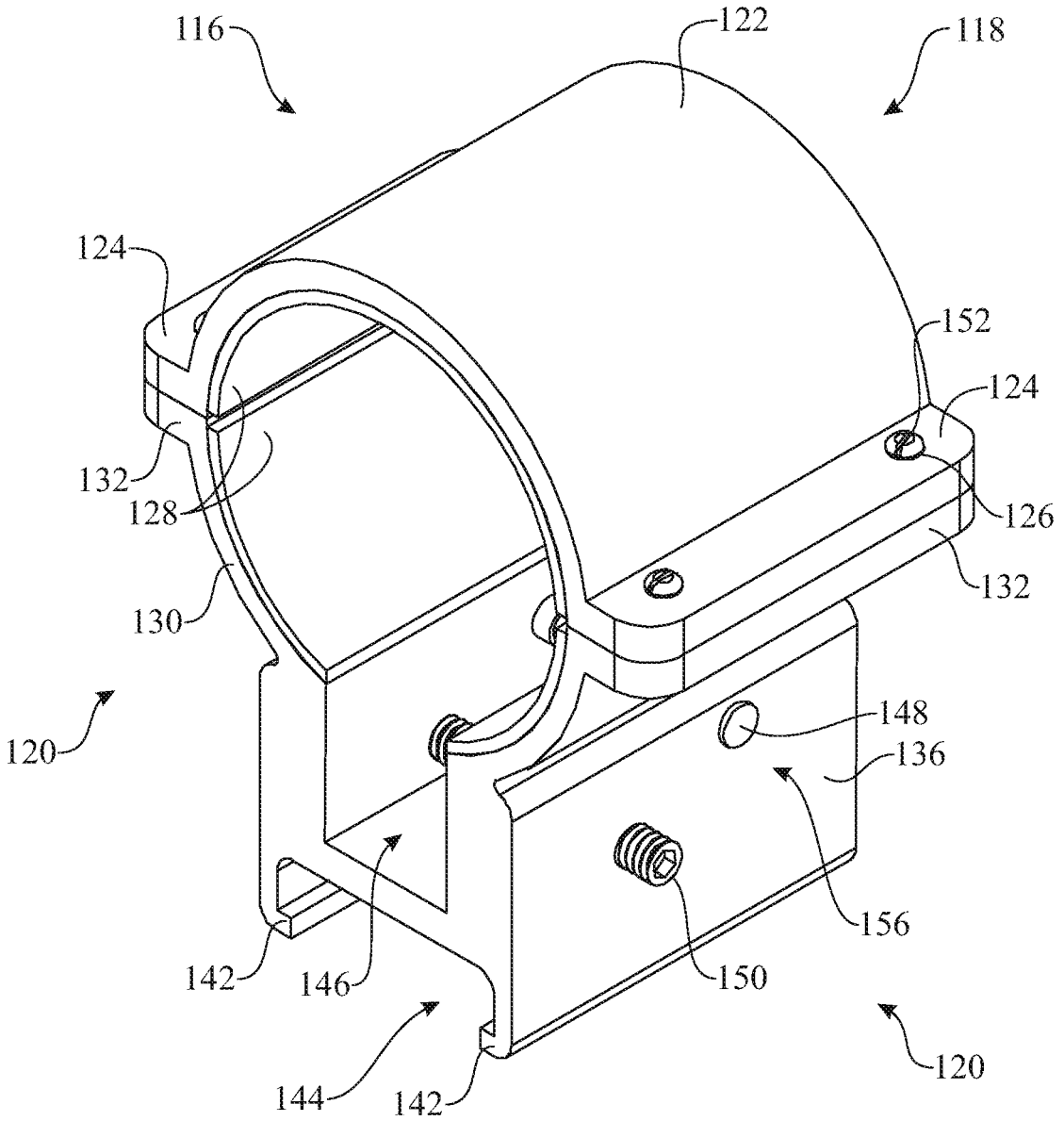
FIG. 5 presents a perspective view of the mounting bracket of the riflescope mount assembly of the present invention.
Figure 6:
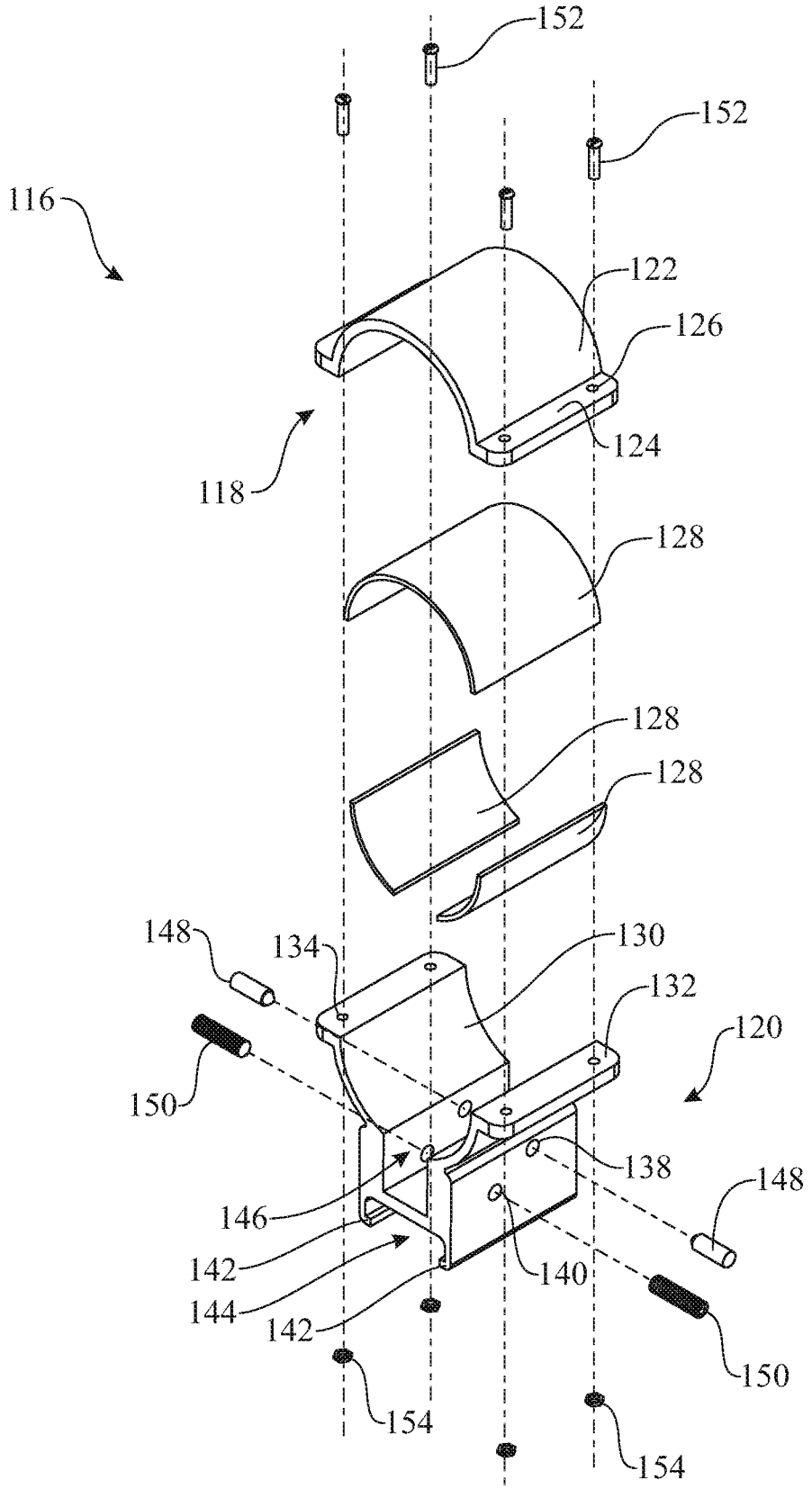
FIG. 6 presents an exploded view of the mounting bracket of the riflescope mount assembly presented in FIG. 5.

Referring to FIGS. 5 and 6, the mounting bracket 116 of the mounting assembly 100 comprises a top element 118 and a bottom element 120. The top element 118 includes a top head 122 and a pair of lateral ledges 124 that extend outwardly from the top head 122. As is shown, the top head 118 of the mounting bracket 116 may include a shaped-head that matches the contour or exterior profile of the riflescope. In one exemplary form, the top head 118 of the mounting bracket includes a concave-shaped head and is made out of a hard material, such as hard plastic. Alternative materials, however, such as metal, composites, or the like may be the source material used to make up the top element without departing from the scope of the invention. With continued reference to FIGS. 5 and 6, the bottom element 120 of the mounting bracket 116 includes a bottom head 130, a neck portion 136 supporting the bottom head 130, and a pair of mounting shoulders 142 extending downwardly from the neck portion 136, all-of-which are in a unitary construction. In similar fashion to the top head 118, the bottom head 130 of the bottom element 120 may include a pair of lateral edges 132 that extend outwardly from the bottom head 130. The bottom head 130 of the mounting bracket 116 may also include a shaped or formed head that matches the contour of the riflescope 200. Thus in one exemplary form, the bottom head includes a convex-shaped head.

The neck portion 136 of the mounting bracket that supports the bottom head 130 of the mounting assembly 116 are integrally formed to provide a unitary body. Unlike the bottom head 130 that generally has a curved shape, the neck portion 136 of the mounting bracket 116 has a rectangular shape that includes a passageway 146. The neck portion 136 of the mounting bracket may also include an auto indexing mechanism 156 that corrects cant usually introduced when the user mounts the riflescope to the rifle. How the auto indexing mechanism 156 corrects cant will be described further herein below. In a preferred embodiment, the auto indexing mechanism 156 comprises a pair of resilient members 148 that engage the index bar 102 attached to the riflescope 200. In one exemplary form, the resilient member 148 may include a spring-loaded ball detent that forms a bearing surface that retracts and snaps back into an opposing hole or groove. The mounting bracket 116 may also include a mechanical indexing mechanism 158 that allows for manual correction to account for windage or elevation. In one exemplary form, the mechanical indexing mechanism may include a pair of members 150, such as set screws that engage the indexing bar 102 at its opposite sides 112.

As briefly mentioned above, the mounting assembly 116 includes a pair of mounting shoulders 142 that extend downwardly from the neck 136 of the mounting assembly 116. The mounting shoulders 142 form a passageway 144 that engages the mounting rack 210 included on the rifle 212 (FIG. 1). It should be readily apparent that the shape of the shoulders 142 of the mounting assembly 116 may be altered to match the different types of mounting racks that are included in different rifles. Therefore, the description detailed above is exemplary and not limiting.

Referring now to FIGS. 1 through 7, an exemplary description is now provided describing the assembly process of how the mount assembly 100 may be mounted to the riflescope 200.

Referring to FIG. 4, the assembly process generally comprises attaching the mounting tabs 202 to the rifle scope 200 if the riflescope has not been pre-manufactured with the mounting tabs (as described above). After the mounting tabs 202 are attached or integrally formed to the riflescope 200 the attachment of the index bar 102 follows. Although there are many ways on how one would attach the index bar 102 to the mounting tabs 202, one exemplary form is now described. As illustrated in FIG. 4, there are at least four pairs of mounting tabs disposed about the bottom of the rifle scope. Each pair of mounting tabs include an aperture that are concentrically aligned with one another. Between each pair of mounting tabs is a passage way 206 that is of a necessary width to receive the index bar 102. Accordingly, an index bar 102 is placed, slid, or inserted between the passageway 206. The apertures 110 that are disposed about the opposite sides 108 of the index bar and are proximate to the opposite ends thereof, are aligned with the apertures 204 of two pairs of mounting tabs 202, which is shown in FIG. 5. Once the apertures are aligned, a fastener 114 is fitted into each aperture to secure the index bar 102 to the riflescope 200.

Turning now to FIGS. 2 and 7, before or after the index bar 102 is secured to the riflescope 200, the bottom element 120 of the mounting bracket 116 may be attached to the rifle 212. In one exemplary embodiment, this can be done by sliding the channel or passageway 144 formed by the shoulders 142 of the bottom element 120 through the mounting rack 212 included on the rifle 212. The shoulders 142 of the bottom element securely engage the mounting rack 212 of the rifle, which prevents the bottom element from accidently disengaging the rifle. After the bottom element 120 of the mounting bracket 116 is secured to the rifle 212, the riflescope 200—which at this time has the index bar 102 attached to it—engages with the bottom element 120 of the mounting bracket 116. After the riflescope 200 engages the bottom element 120, the top element 118 of the mounting bracket 116 is disposed over the top portion of the riflescope. The top element 118, and in particular, the extending ledges 122 of the top element 118 are aligned and placed over the ledges 136 of the bottom element 120 until both sets of ledges are in contact (FIG. 3). The apertures 126 on the top element 118 are aligned with the apertures 134 of the bottom element 120, and a fastener 152 is then inserted through and fastened with a nut 154. To ensure that the riflescope is not damaged when the mounting bracket 116 is secured to the riflescope, the mounting bracket 116 includes padding 128 that is disposed about the interior surface of the top and bottom head of the bracket.

The padding 128 included in the mounting bracket 115 provides a protective layer that allows the mounting bracket to be firmly secured to the riflescope without damaging the exterior casing of the riflescope.

With quick reference to FIG. 3, an alternative assembly process may be employed. For example, after the index bar 102 has been secured to the riflescope 200, the mounting bracket 116 may be securely mounted to the riflescope before the riflescope is attached to the rifle. Once the mounting bracket has been mounted to the riflescope, the shoulders of the bottom element can then be used to engage the mounting rack of the rifle to securely mount the riflescope to the rifle.

Referring now to FIGS. 3 and 7-9, an exemplary description is now provided describing how the auto indexing mechanism 156 and the mechanical indexing mechanism 158 on the mount assembly 100 function.

To understand how the present invention corrects or eliminates cant, it is important to discuss how cant is introduced when mounting a riflescope to a rifle. Before the actual mounting of the riflescope takes place, the rifle is placed on a grain vice or gun cradle. The rifle must be perfectly level before moving to the next step. Typically, a bubble level tool is used to ensure that the rifle is completely level. After it is believed that the gun is level, the riflescope is attached to the rifle and again checked with a bubble level to ensure that the scope is level with the rifle. Initially, one must understand that bubble levels may not be accurate enough to eliminate cant. A faulty bubble level will show that the rifle and scope are level, when in reality that is not the case. As discussed above, 3 degrees of cant can represent 3 inches off center.

Furthermore, cant may also be introduced when the riflescope is attached to the mounting bracket that is used to attach the riflescope to the rifle. A conventional riflescope mount includes two pieces that are clamped to a riflescope. Generally, a riflescope has a cylindrical shaped body. The shape of the riflescope makes it exceedingly difficult to gauge what is the optimal position that the riflescope should be placed in between the clamps of the riflescope mount. The slightest error in the plane angle will introduce cant, and thus, affect the trajectory of a bullet in a long range shot. As a result, the riflescope is continuously being adjusted (i.e., rotated within the clamp) to correct the angular error (i.e., cant) introduced during the mounting process.

Unlike existing products, the present invention obviates all of those issues that produce cant when mounting the riflescope to the rifle. As shown in FIG. 7, the index bar 102 runs along the same plane as the vertical crosshair 208 on the scope's reticle 214. When the riflescope 200 is mounted to the bottom element 120 of the mounting bracket 116, the index bar 102 attached to the riflescope 200 engages the auto indexing mechanism 156 that peer through the opening 138 on the neck portion 136 of the bottom element 120. The auto indexing mechanism engages the index bar and positions the scope to its true vertical plane VT, which in-turn causes the reticle to match the same vertical angle. The auto indexing mechanism eliminates the need to rotate the riflescope in the clockwise or counter clockwise position to correct cant.

Figure 8:
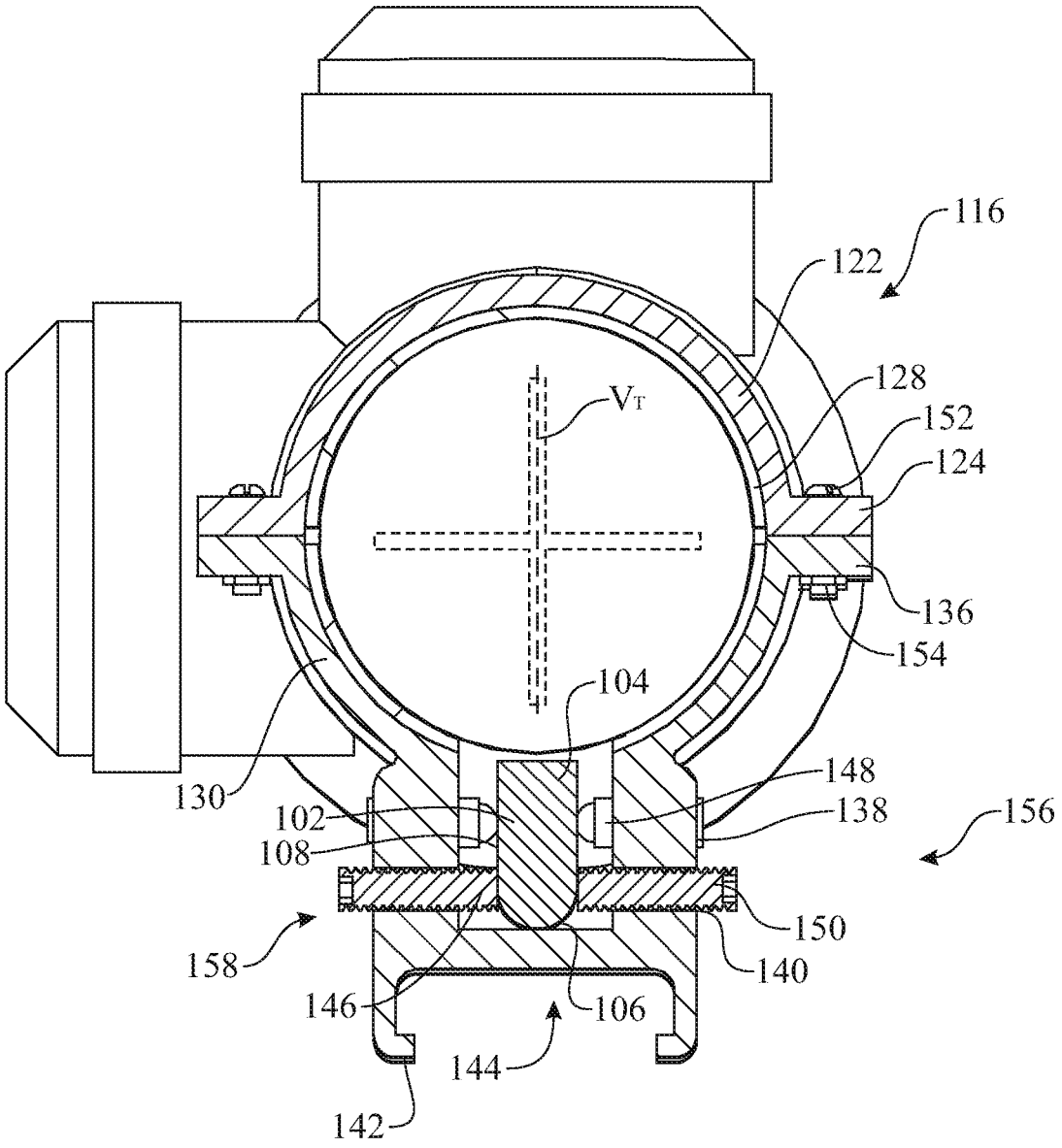
FIG. 8, presents a cross-sectional view of the mounting bracket attached to a riflescope mount.
Figure 9:
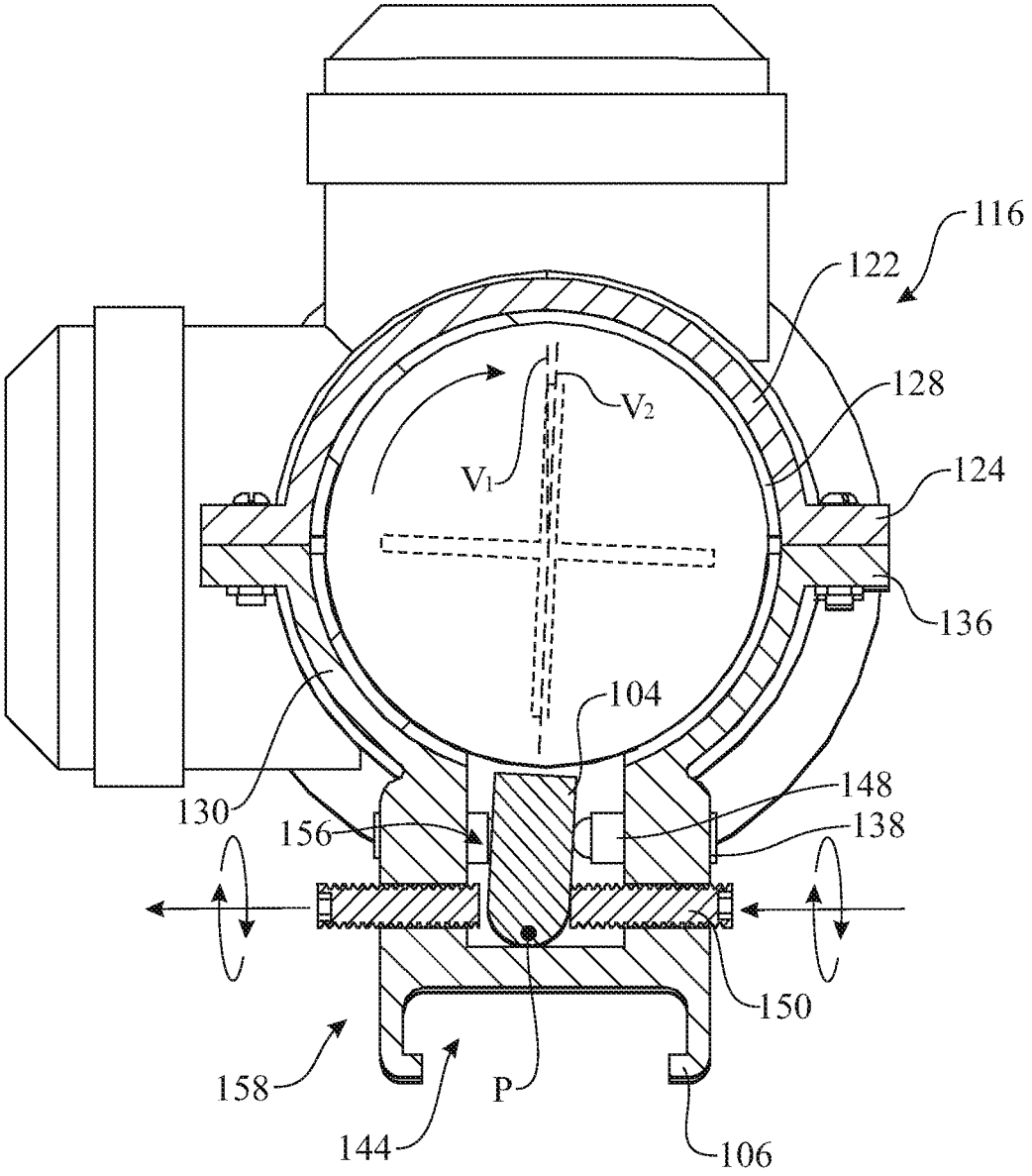
FIG. 9 presents a cross-sectional view of the mounting bracket attached to a riflescope mount.

Turning now to FIGS. 8 and 9, although the auto indexing mechanism 156 aligns the scope to its true vertical plane V'r, the riflescope mount assembly 100 includes a mechanical indexing mechanism 158 that can be used to alter the position of the riflescope within the mount 116. The mechanical indexing mechanism 158 may be used in two exemplary ways. For example, in the first instance where the mechanical indexing mechanism 158—which may include in one exemplary from a pair of setscrews 150 that peer through a threaded hole 140 provided on the neck portion of the mounting bracket—may be tightened or moved inwardly until the head of each setscrew 150 makes contact with an opposite side 108 of the index bar 102. The setscrews 150 hold or lock the index bar (and in-turn the riflescope) in place. Using the mechanical indexing mechanism to lock the index bar in place may be useful when mounting the riflescope to the rifle (as seen in FIGS. 1 and 3), so that the riflescope does not shift during the mounting process. Alternatively, the mechanical index mechanism may be used while actively shooting to prevent the riflescope from jarring loose or shifting position.

Sometimes during a difficult shot, windage and elevation must be accounted for. Typically, the riflescope's turrets are used to adjust for windage and elevation. When minor corrections are necessary but are nonetheless made with the turrets, the turrets become ineffective because the necessary change needed is outside of its purview. Accordingly, the present invention provides means to address such drawbacks. Turning now to FIG. 9, the mechanical indexing mechanism 158 may be used to make minor corrections and shift or adjust the reticle from its original position $V_1$ to a second position $V_2$. This is done by tightening one element 150 of the mechanical indexing mechanism to pivot index bar 102. For example, as shown in FIG. 9, the right element 150 of the indexing mechanism may be tightened more than the left element 150, causing the rounded bottom 106 of the index bar 102 to rotate about a pivot point P. As the rounded bottom 106 of the index bar pivots about point P, the top portion of the index bar leans towards one side causing one of the indexing mechanism 156 to compress. As the index bar pivots the scope also changes position. It should be readily apparent that the corrections made by the mechanical indexing mechanism are minor and used when the use of a scope turret is ineffective, and thus, the mechanism is not design to eliminate or substitute scope turrets.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A riflescope mount assembly that includes a cant correction mechanism to correct cant introduced when mounting a riflescope to a rifle, the riflescope mount assembly comprising:

at least one indexing bar attachable to a riflescope; and at least one riflescope mounting bracket for securing the riflescope to a rifle, the mounting bracket including at least one auto indexing mechanism, wherein the auto indexing mechanism of the riflescope mounting bracket engages the at least one indexing bar attachable to the riflescope to correct cant by aiding in aligning the rifle's vertical reticle to a true vertical position, and wherein the indexing bar comprises an elongated body having a flat top, a rounded bottom, a pair of opposite sides, and a pair of opposite ends.

2. The riflescope mount assembly of claim 1, wherein the indexing bar includes at least a pair of through openings near the opposite ends of the elongated body, the through openings extending from a side to an opposite side, each through opening on the indexing bar concentrically alignable with openings provided on a pair of mounting tabs attachable to a bottom portion of the riflescope.

3. The riflescope mount assembly of claim 1, wherein the riflescope mounting bracket comprises, an upper portion clamp device, and a lower portion attachment device extending downwardly from the upper portion clamp device, the attachment device including a first passageway configured to receive the at least one indexing bar therein, the attachment device including a second passageway, below the first passageway, configured to used to mount the riflescope mounting bracket to the rifle.

4. The riflescope mount assembly of claim 3, wherein the lower portion attachment device includes a pair of shoulders that form the second passageway for receiving a mounting rack of the rifle therethrough, the pair of shoulders securely holding the riflescope mounting bracket to the rifle.

5. The riflescope mount assembly of claim 3, wherein an interior surface of the upper portion clamp device includes a padded surface that makes contact with the riflescope when the upper portion clamp device is secured to the riflescope.

6. The riflescope mount assembly of claim 1, wherein the auto indexing mechanism includes a pair of resilient members disposed about a bottom portion of the riflescope mounting mechanism, the pair of resilient members configured to engage the at least one indexing bar when the indexing bar makes contact with the bottom portion of the riflescope mounting mechanism to align the vertical reticle of the riflescope to true vertical.

7. The riflescope mount assembly of claim 1, wherein the riflescope mount assembly further comprises a mechanical indexing mechanism, the mechanical indexing mechanism including a pair of set screws disposed about a bottom portion of the riflescope mounting mechanism that are configured to be selectively used to make contact with the at least one indexing bar when the indexing bar makes contact with the bottom portion of the riflescope mounting mechanism.

8. A riflescope mount assembly that includes a cant correction mechanism to correct cant introduced when mounting a riflescope to a rifle, the riflescope mount assembly comprising:

a plurality of mounting tabs attachable to a bottom portion of a riflescope;

at least two indexing bars, each indexing bar comprising an elongated body having a flat top, a rounded bottom, a pair of opposite sides, and a pair of opposite ends, wherein the at least two indexing bars are attachable to the plurality of mounting tabs when the mounting tabs are attached to the bottom portion of the riflescope; and at least two riflescope mounting brackets for securing the riflescope to a rifle, each one of the mounting brackets including at least one auto indexing mechanism about a bottom portion, wherein the auto indexing mechanism of each of the riflescope mounting brackets engages a central portion of one indexing bar and is usable to correct cant by vertically aligning the rifle's vertical reticle to true vertical when mounting the riflescope to the riflescope mounting bracket and the riflescope mounting bracket to the rifle.

9. The riflescope mount assembly of claim 8, wherein the plurality of mounting tabs are provided in a plurality of pairs, each pair having two tabs arranged in a spaced-apart relationship forming a gap between each tab, and each pair is spaced-apart longitudinally along the bottom portion of the riflescope to create a passageway.

10. The riflescope mount assembly of claim 9, wherein the indexing bars fit within the gap formed between each pair, and each opposite end of the indexing bar is selectively attachable to a respective pair such that the at least two indexing bars extend one after another along the same longitudinal passage way formed by the plurality of mounting tabs.

11. The riflescope mount assembly of claim 8, wherein the riflescope mount assembly further comprises a mechanical indexing mechanism disposed about the bottom portion of the riflescope mounting mechanism and inferior to the auto indexing mechanism, the mechanical indexing mechanism configured to be selectively engageable with at least one indexing bar when the indexing bar makes contact with the bottom portion of the riflescope mounting mechanism.

12. The riflescope mount assembly of claim 8, wherein each one of the riflescope mounting bracket comprises, a top head portion selectively attachable to a bottom head portion;

a neck portion supporting the bottom head portion; and a pair of shoulders extending downwardly from the neck portion.

13. The riflescope mount assembly of claim 12, wherein the top head portion is a concave-shaped head that includes a pair of lateral wings with at least one opening on each lateral wing, and the bottom head portion is a convex-shaped head that includes a pair of lateral wings with at least one opening on each lateral wing, the opening on each lateral wing on the top head portion alignable with the opening on each lateral wing on the bottom head portion, each opening configured to receive a fastener there through to securely fasten the top head portion of the riflescope mounting bracket to the bottom head portion.

14. The riflescope mount assembly of claim 12, wherein an interior surface of the top head portion and the bottom head portion includes a padded surface.

15. The riflescope mount assembly of claim 12, wherein the neck portion includes a first passageway, and disposed on opposite sides of the neck portion is a pair of resilient members with each resilient member piercing into the first passageway, the pair of resilient members configured to engage an indexing bar when the indexing bar is inserted into the first passageway.

16. The riflescope mount assembly of claim 12, wherein the neck portion includes a mechanical indexing mechanism about a first passageway, the mechanical indexing mechanism includes a pair of set screws disposed on opposite sides of the neck portion, inferior to the auto indexing mechanism, the set screws piercing into the first passageway, the pair of set screws configured to engage an indexing bar when the indexing bar is inserted into first passageway.

17. A riflescope mount assembly that includes a cant correction mechanism to correct cant introduced when mounting a riflescope to a rifle, the riflescope mount assembly comprising:

a riflescope including a plurality of mounting tabs irremovably attached to a bottom portion of a riflescope, the plurality of mounting tabs provided in a plurality of pairs, each pair having two tabs arranged in a spaced-apart relationship forming a gap between each tab, and each pair is spaced-apart longitudinally along the bottom portion of the riflescope to create a passageway;

at least two indexing bars, each indexing bar comprising an elongated body having a flat top, a rounded bottom, a pair of opposite sides, and a pair of opposite ends, wherein the at least two indexing bars are insertable within the passageway and attachable to the plurality of mounting; and at least two riflescope mounting brackets for securing the riflescope to the rifle, each one of the mounting brackets including an auto indexing mechanism and a mechanical indexing mechanism about a bottom portion of the riflescope mounting bracket to aid in aligning the rifle's vertical reticle to a true vertical position.

18. The riflescope mount assembly of claim 17, wherein each one of the riflescope mounting bracket comprises, a top head portion selectively attachable to a bottom head portion, wherein the top head portion is a concave-shaped head that includes a pair of lateral wings with at least one opening on each lateral wing, and the bottom head portion is a convex-shaped head that includes a pair of lateral wings with at least one opening on each lateral wing, the opening on each lateral wing on the top head portion alignable with the opening on each lateral wing on the bottom head portion, each opening configured to receive a fastener there through to securely fasten the top head portion of the riflescope mounting bracket to the bottom head portion;

a neck portion supporting the bottom head portion, wherein the neck portion includes a first passageway, wherein disposed on opposite sides of the neck portion is the auto indexing mechanism that comprises a pair of resilient members piercing into the first passageway, the pair of resilient members configured to engage at least one indexing bar when the indexing bar is inserted into the first passageway, wherein the mechanical indexing mechanism includes a pair of set screws disposed on opposite sides of the neck portion piercing into the first passageway, the pair of set screws positioned inferior to the pair of resilient members of the auto indexing mechanism, and the pair of set screws configured to engage an indexing bar when the indexing bar is inserted into the first passageway; and a pair of shoulders extending downwardly from the neck portion, wherein the pair of shoulders form a second passageway for receiving a mounting rack of the rifle therethrough, the pair of shoulders securely holding the riflescope mounting bracket to the rifle.

19. The riflescope mount assembly of claim 18, wherein an interior surface of the top head portion and the bottom head portion includes a padded surface.

20. A riflescope mount assembly that includes a cant correction mechanism to correct cant introduced when mounting a riflescope to a rifle, the riflescope mount assembly comprising:

at least one indexing bar attachable to a riflescope; and at least one riflescope mounting bracket for securing the riflescope to a rifle, the mounting bracket comprises, at least one auto indexing mechanism, an upper portion clamp device, and a lower portion attachment device extending downwardly from the upper portion clamp device, the attachment device including a first passageway configured to receive the at least one indexing bar therein, the attachment device including a second passageway, below the first passageway, configured to used to mount the riflescope mounting bracket to the rifle, wherein the auto indexing mechanism of the riflescope mounting bracket engages the at least one indexing bar attachable to the riflescope to correct cant by aiding in aligning the rifle's vertical reticle to a true vertical position, and wherein the lower portion attachment device includes a pair of shoulders that form the second passageway for receiving a mounting rack of the rifle therethrough, the pair of shoulders securely holding the riflescope mounting bracket to the rifle.

21. A riflescope mount assembly that includes a cant correction mechanism to correct cant introduced when mounting a riflescope to a rifle, the riflescope mount assembly comprising:

at least one indexing bar attachable to a riflescope; and at least one riflescope mounting bracket for securing the riflescope to a rifle, the mounting bracket comprises, at least one auto indexing mechanism, an upper portion clamp device, and a lower portion attachment device extending downwardly from the upper portion clamp device, the attachment device including a first passageway configured to receive the at least one indexing bar therein, the attachment device including a second passageway, below the first passageway, configured to used to mount the riflescope mounting bracket to the rifle, wherein an interior surface of the upper portion clamp device includes a padded surface that makes contact with the riflescope when the upper portion clamp device is secured to the riflescope, and wherein the auto indexing mechanism of the riflescope mounting bracket engages the at least one indexing bar attachable to the riflescope to correct cant by aiding in aligning the rifle's vertical reticle to a true vertical position.

* * * * *